US005645258A

United States Patent [19]

Flowers

[11] Patent Number: 5,645,258

[45] Date of Patent: Jul. 8, 1997

[54] HOSPITAL BED WALL SECURING DEVICE

[76] Inventor: Michael R. Flowers, 4625 Harrison St., Bellaire, Ohio 43906

[21] Appl. No.: 489,670

[22] Filed: Jun. 12, 1995

[51] Int. Cl.[6] ..... A47B 96/06

[52] U.S. Cl. ..... 248/298.1; 248/501; 248/316.5

[58] Field of Search ..... 248/298.1, 316.8, 248/316.4, 500, 501, 680, 681, 224.61, 230.4, 316.5, 291.1; 5/503.1; 24/437, 517, 573.1; 182/214

[56] References Cited

U.S. PATENT DOCUMENTS

| | | | |
|---|---|---|---|
| 2,272,642 | 2/1942 | Owen | 182/214 X |
| 2,619,307 | 11/1952 | Cramer | 248/500 X |
| 2,893,676 | 7/1959 | Connors et al. | 248/224.61 X |
| 4,055,320 | 10/1977 | Bengtsson | 248/501 |
| 4,502,566 | 3/1985 | Wing | 182/214 |
| 4,669,695 | 6/1987 | Chou | 248/500 |
| 5,215,163 | 6/1993 | Kent, Sr. et al. | 182/214 X |
| 5,261,507 | 11/1993 | Williams et al. | 182/214 |
| 5,415,371 | 5/1995 | Kirchner | 248/316.4 |

*Primary Examiner*—Ramon O. Ramirez
*Assistant Examiner*—Gwendolyn W. Baxter

[57] ABSTRACT

A device for securing a bed to a wall. The inventive device includes a mounting plate securable to a wall surface. A fixed engaging member is mounted to the mounting plate and receives a first leg of a bed. A movable engaging member is coupled to the mounting plate and can be positioned into engagement with a second leg of the bed to secure the bed relative to the wall.

1 Claim, 3 Drawing Sheets

FIG 1
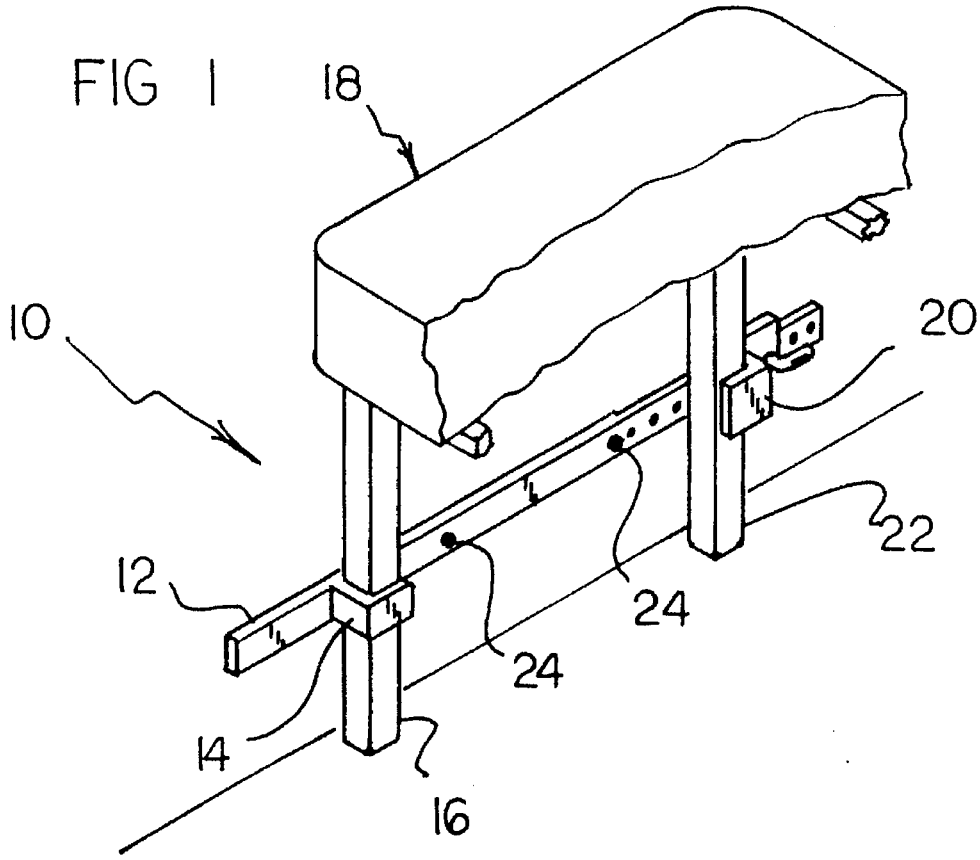
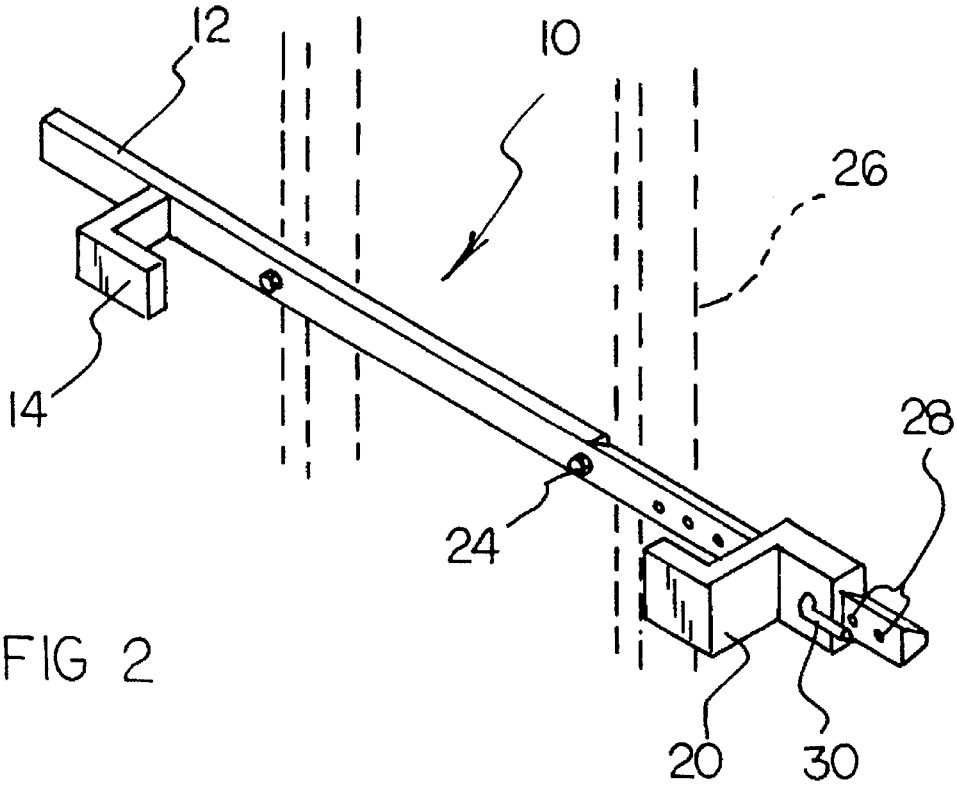
FIG 2

FIG 3
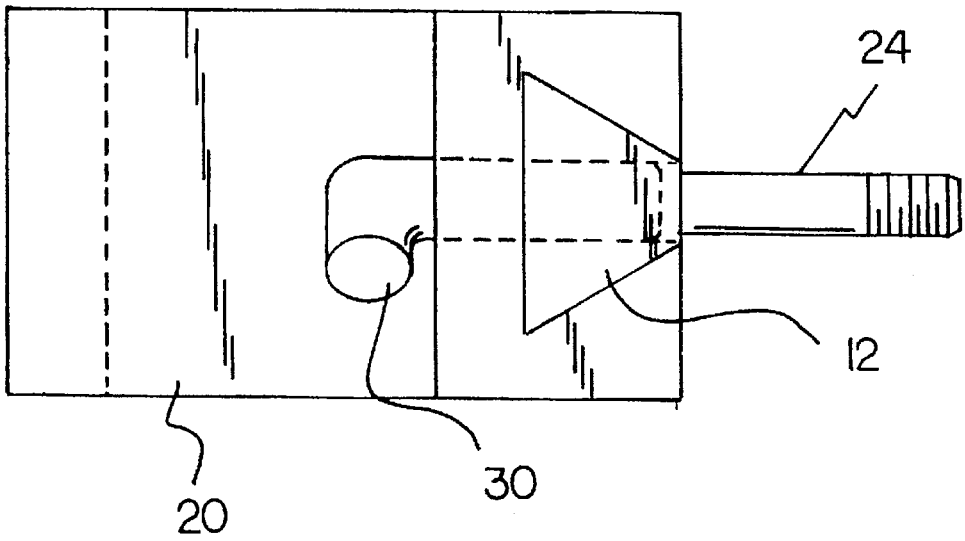
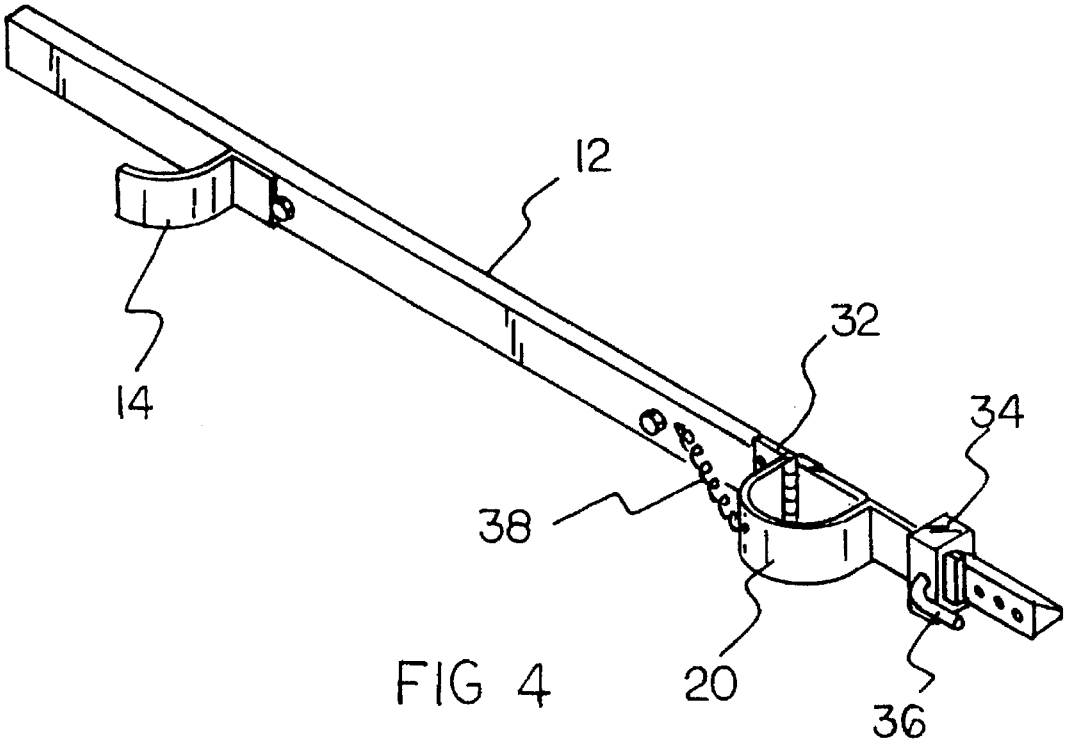
FIG 4

HOSPITAL BED WALL SECURING DEVICE

BACKGROUND OF THE INVENTION

1. Field of the Invention

The present invention relates to holding structures and more particularly pertains to a hospital bed wall securing device for securing a bed to a wall.

2. Description of the Prior Art

The use of holding structures is known in the prior art. More specifically, holding structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding structures include U.S. Pat. No. 5,205,524; 5,308,031; 4,074,884; 5,239,713; 4,858,261; and 5,177,822.

While these devices fulfill their respective, particular objectives and requirements, the aforementioned patents do not disclose a hospital bed wall securing device for securing a bed to a wall which includes a mounting plate securable to a wall surface, a fixed engaging member mounted to the mounting plate for receiving a first leg of a bed, and a movable engaging member coupled to the mounting plate which can be positioned into engagement with a second leg of the bed to secure the bed relative to the wall.

In these respects, the hospital bed wall securing device according to the present invention substantially departs from the conventional concepts and designs of the prior art, and in so doing provides an apparatus primarily developed for the purpose of securing a bed to a wall.

SUMMARY OF THE INVENTION

In view of the foregoing disadvantages inherent in the known types of holding structures now present in the prior art, the present invention provides a new hospital bed wall securing device construction wherein the same can be utilized for securing a bed or other furniture structure to a wall. As such, the general purpose of the present invention, which will be described subsequently in greater detail, is to provide a new hospital bed wall securing device apparatus and method which has many of the advantages of the holding structures mentioned heretofore and many novel features that result in a hospital bed wall securing device which is not anticipated, rendered obvious,, suggested, or even implied by any of the prior art holding structures, either alone or in any combination thereof.

To attain this, the present invention generally comprises a device for securing a bed to a wall. The inventive device includes a mounting plate securable to a wall surface. A fixed engaging member is mounted to the mounting plate and receives a first leg of a bed. A movable engaging member is coupled to the mounting plate and can be positioned into engagement with a second leg of the bed to secure the bed relative to the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carded out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hospital bed wall securing device apparatus and method which has many of the advantages of the holding structures mentioned heretofore and many novel features that result in a hospital bed wall securing device which is not anticipated, rendered obvious, suggested, or even implied by any of the prior art tool guides, either alone or in any combination thereof.

It is another object of the present invention to provide a new hospital bed wall securing device which may be easily and efficiently manufactured and marketed.

It is a further object of the present invention to provide a new hospital bed wall securing device which is of a durable and reliable construction.

An even further object of the present invention is to provide a new hospital bed wall securing device which is susceptible of a low cost of manufacture with regard to both materials and labor, and which accordingly is then susceptible of low prices of sale to the consuming public, thereby making such hospital bed wall securing devices economically available to the buying public.

Still yet another object of the present invention is to provide a new hospital bed wall securing device which provides in the apparatuses and methods of the prior art some of the advantages thereof, while simultaneously overcoming some of the disadvantages normally associated therewith.

Still another object of the present invention is to provide a new hospital bed wall securing device for securing a bed or other article of furniture to a wall surface.

Yet another object of the present invention is to provide a new hospital bed wall securing device which includes a mounting plate securable to a wall surface, a fixed engaging member mounted to the mounting plate for receiving a first leg of a bed, and a movable engaging member coupled to the mounting plate which can be positioned into engagement with a second leg of the bed to secure the bed relative to the wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a hospital bed wall securing device according to the present invention in use.

FIG. 2 is a further isometric illustration of the invention.

FIG. 3 is an end elevation view thereof.

FIG. 4 is an isometric illustration of an alternative form of the present invention.

DESCRIPTION OF THE PREFERRED EMBODIMENT

Figure 5:
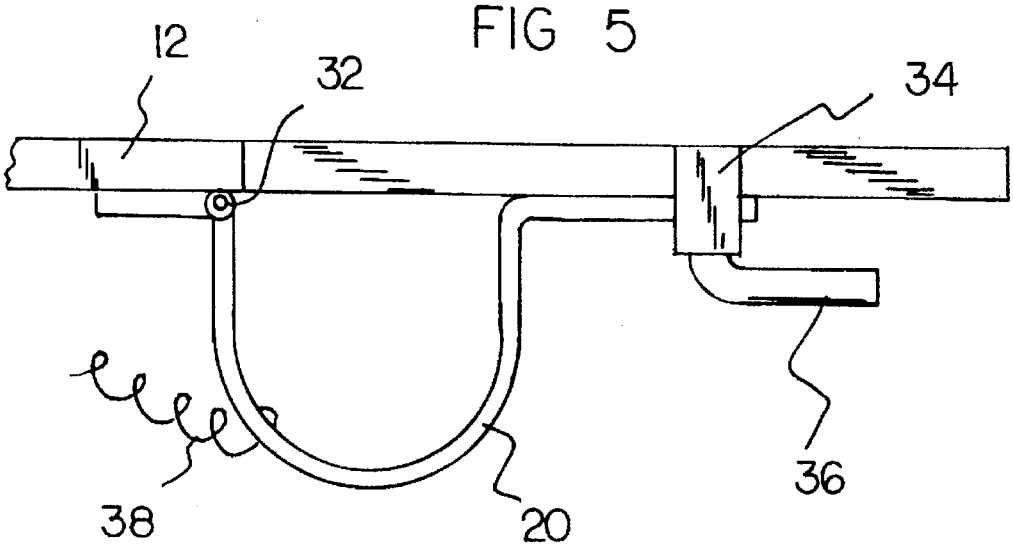
FIG. 5 is an enlarged top plan view of a portion of the alternative form of the invention illustrated in FIG. 4.

With reference now to the drawings, and in particular to FIGS. 1–6 thereof, a new hospital bed wall securing device embodying the principles and concepts of the present invention and generally designated by the reference numeral 10 will be described.

More specifically, it will be noted that the hospital bed wall securing device 10 comprises an elongated mounting plate 12 securable to a wall surface such as is illustrated in FIG. 1 of the drawings. A fixed engaging member 14 is mounted to the mounting plate 12 proximal to a first end thereof and operates to receive a first leg 16 of a bed 18 such as a hospital bed or the like. A movable engaging member 20 is movably mounted relative to the mounting plate 12 and operates to engage a second leg 22 of the bed 18 so as to secure the legs 16 and 22 relative to the wall surface to preclude movement of the associated bed 18.

Referring now to FIGS. 2 and 3 wherein the present invention 10 is illustrated in detail, it can be shown that the mounting plate 12 is shaped so as to define a plurality of unlabeled apertures extending therethrough permitting the passage of mounting fasteners 24 through the mounting plate 12 and into a portion 26 of a wall such as a stud or the like. Further, the mounting plate 12 is shaped so as to define a plurality of adjustment apertures 28 directed into a front face of the mounting plate 12 and extending from a second end thereof along a portion of a longitudinal length of the mounting plate. The moveable engaging member 20 is slidably mounted to the mounting plate 12 and includes a through-extending aperture through which a securing pin 30 can be projected for positioning into one of the adjustment apertures 28 so as to lock the movable engaging member 20 relative to the mounting plate 12. By this structure, the legs 16 and 22 of the associated bed 18 can be captured between the engaging members 14 and 20 so as to secure the bed 18 relative to the wall surface. As shown in FIG. 3, the second end of the mounting plate 12 is preferably shaped so as define a dove-tailed projection which is received within a correspondingly shaped recess directed through the movable engaging member 20 so as to slidably couple the movable engaging member relative to the mounting plate 12.

Referring now to FIGS. 4 and 5 wherein an alternative form of the present invention 10 is illustrated in detail, it can be shown that the movable engaging member 20 may alternatively be pivotally mounted to the mounting plate 12 by a hinge 32 interposed between the movable engaging member 20 and the mounting plate 12. The hinge 32 thus permits the movable engaging member 20 to be pivoted about the second leg 22 of a bed 18 so as to couple the legs 16 and 22 relative to the wall surface. To secure the movable engaging member 20 in the closed orientation illustrated in FIG. 4, a securing collar 34 is slidably mounted along the second end of the mounting plate 12 and includes a securing pin 36 which can be extended through a portion of the movable engaging member 20 and into an unillustrated aperture in the mounting plate 12 so as to block the movable engaging member 20 in the closed orientation. To facilitate automatic opening or pivoting of the movable engaging member 20 subsequent to movement of the securing collar 34 away from an engaged portion of the movable engaging member, a spring 38 is coupled to the movable engaging member 20 and extends under tension to couple with the mounting plate 12. By this structure, a rapid decoupling of the bed 18 from the device 10 can be accomplished as desired. Preferably, the second end of the mounting plate 12 in the alternative form of the present invention 10 is also shaped in a dove-tailed configuration and projects through a correspondingly shaped dove-tailed groove of the securing collar 34.

Figure 6:
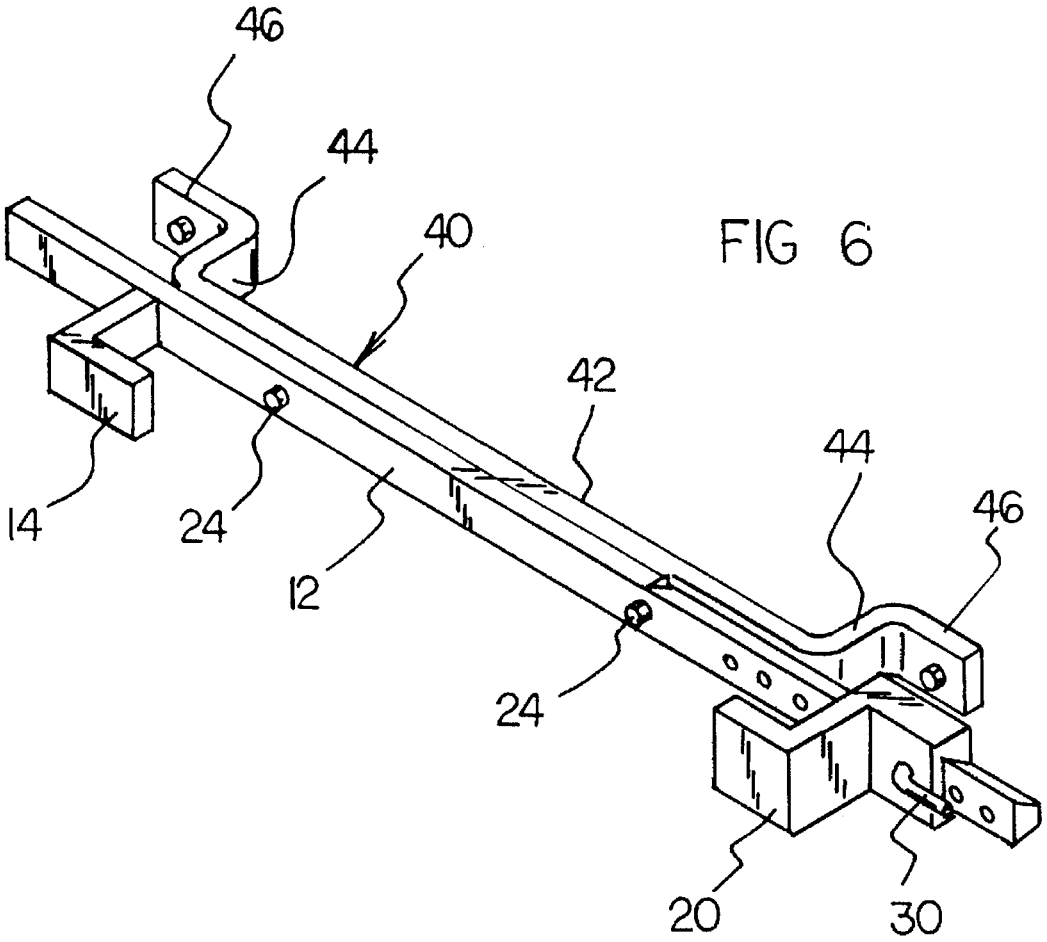
FIG. 6 is an isometric illustration of the present invention including a spacer assembly.

Referring now to FIG. 6, it can be shown that the present invention 10 may additionally comprise a spacer assembly 40 secured to a rear surface of the mounting plate 12 for mounting the mounting plate 12 in a spaced and parallel orientation relative to a wall surface to permit accommodation of certain types of hospital beds 18 which include projecting structures such as railings or the like. To this end, the spacer assembly 40 desirably includes a center plate 42 coupled to the rear surface of the mounting plate 12 by the mounting fasteners 24 directed therethrough. A pair of support stanchions 44 extend from opposed ends of the center plate 42. End plates 46 project from the respective support stanchions 44 and into a substantially spaced and parallel orientation relative to the center plate 42. The end plates 46 are each shaped so as to define at least one mounting aperture directed therethrough permitting securement of the spacer assembly 40 to an associated wall surface. By this structure, the spacer assembly 40 supports the mounting plate 12 in a spaced and parallel orientation relative to the wall surface as desired or deemed necessary to accommodate a particular style or type of bed 18.

In use, the hospital bed wall securing device 10 according to the present invention can be easily utilized to effect securement of an article of furniture such as a bed 18 or the like relative to a wall surface so as to preclude unintentional movement of the bed by patients and/or individuals utilizing the bed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hospital bed wall securing device comprising:

an elongated mounting plate securable to a wall surface, the mounting plate shaped so as to define a plurality of apertures extending therethrough permitting passage of mounting fasteners through the mounting plate shaped and into a portion of the wall surface, the mounting plate shaped so as to define a plurality of adjustment apertures directed into a front face of the mounting plate and extending from a second end thereof along a portion of a longitudinal length of the mounting plate;

a fixed engaging member mounted to the mounting plate proximal to a first end thereof for receiving a first leg of a bed;

a movable engaging member pivotally mounted proximal to the second end of the mounting plate by a hinge for engaging a second leg of the bed so as to secure the legs relative to the wall surface to preclude movement of the bed, a securing collar slidably mounted to the mounting plate and including a through-extending aperture, a spring coupled to the movable engaging member and extends under tension to couple with the mounting plate;

a securing pin projecting through the movable engaging member and positioned into one of the adjustment apertures so as to lock the movable engaging member relative to the mounting aperture.

* * * * *